US007861826B2

(12) United States Patent
Meyers et al.

(10) Patent No.: US 7,861,826 B2
(45) Date of Patent: Jan. 4, 2011

(54) PLATFORM FOR A LADDER

(75) Inventors: Thomas J. Meyers, Greenwood, IN (US); Paul F. Meyers, Fishers, IN (US)

(73) Assignee: Cosco Management, Inc., Wilmington, DE (US)

( * ) Notice: Subject to any disclaimer, the term of this patent is extended or adjusted under 35 U.S.C. 154(b) by 659 days.

(21) Appl. No.: 11/847,655

(22) Filed: Aug. 30, 2007

(65) Prior Publication Data

US 2008/0053751 A1 Mar. 6, 2008

Related U.S. Application Data

(60) Provisional application No. 60/824,060, filed on Aug. 30, 2006.

(51) Int. Cl.
*E06C 7/16* (2006.01)

(52) U.S. Cl. ..... 182/121; 182/115; 182/116; 182/119; 182/120; 182/124

(58) Field of Classification Search ..... 182/115, 182/116, 117, 120, 121, 122, 150; 248/210, 248/238

See application file for complete search history.

(56) References Cited

U.S. PATENT DOCUMENTS

| | | | | | |
|---|---|---|---|---|---|
| 407,079 | A * | 7/1889 | Laskey | 182/121 |
| 467,685 | A * | 1/1892 | Hammon | 182/22 |
| 606,763 | A * | 7/1898 | Lukens | 248/238 |
| 652,010 | A * | 6/1900 | Wheeler | 248/236 |
| 2,665,952 | A * | 1/1954 | Edwards | 182/122 |
| 2,709,626 | A * | 5/1955 | Woodburn | 182/121 |
| 3,899,045 | A * | 8/1975 | Geisel et al. | 182/121 |
| 4,306,700 | A * | 12/1981 | Bell | 248/238 |
| 4,425,985 | A * | 1/1984 | Geisel et al. | 182/121 |
| 4,646,878 | A * | 3/1987 | Moyer | 182/121 |
| 4,972,923 | A * | 11/1990 | Krause | 182/121 |
| 5,460,241 | A * | 10/1995 | LaBelle | 182/214 |
| 6,637,548 | B2 * | 10/2003 | Pass | 182/121 |
| 6,902,034 | B2 | 6/2005 | Gibson et al. | |
| 7,104,362 | B2 | 9/2006 | Meeker | |
| 2006/0249331 | A1 | 11/2006 | Meeker | |

* cited by examiner

*Primary Examiner*—Katherine W Mitchell
*Assistant Examiner*—Colleen M Quinn
(74) *Attorney, Agent, or Firm*—Barnes & Thornburg LLP

(57) ABSTRACT

The present disclosure relates to platforms for ladders. More particularly, the present disclosure relates to a platform configured to be coupled to rungs of the ladder.

22 Claims, 11 Drawing Sheets

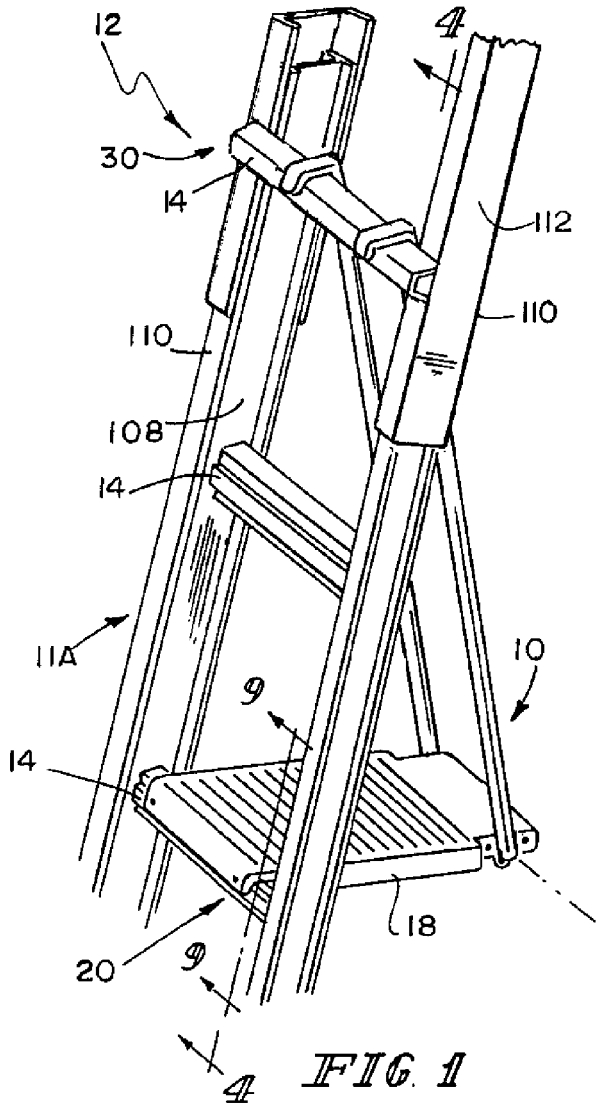
FIG. 1
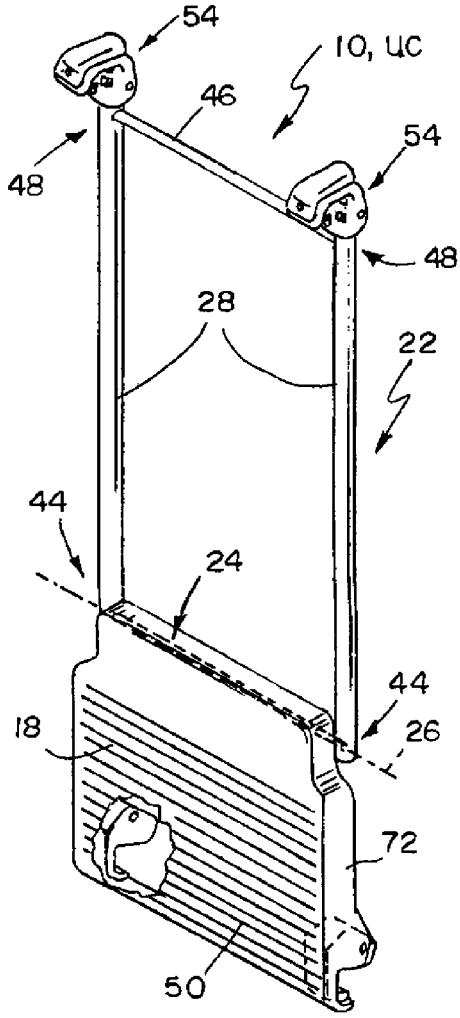
FIG. 2
FIG. 3
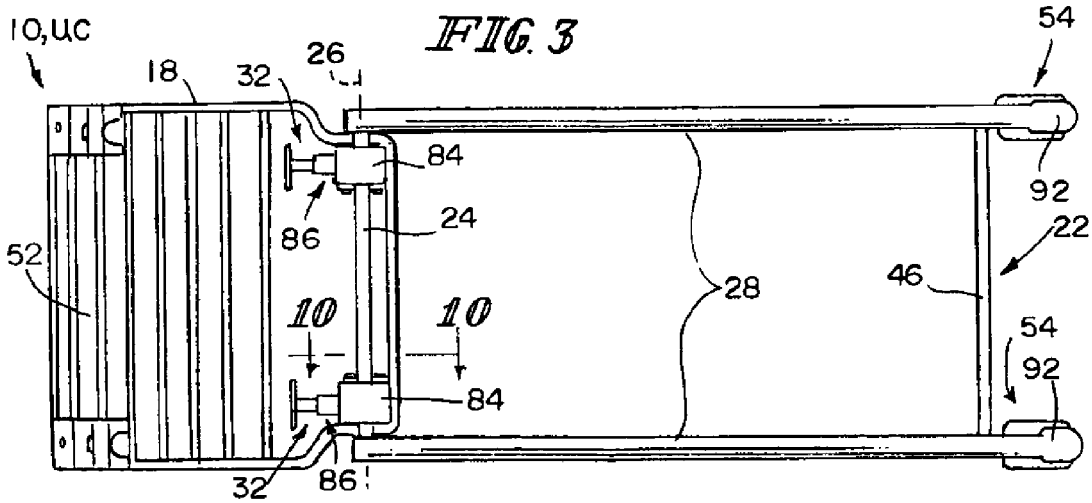

PLATFORM FOR A LADDER

This application claims priority under 35 U.S.C. §119(e) to U.S. Provisional Application Ser. No. 60/824,060, filed Aug. 30, 2006, which is expressly incorporated by reference herein.

BACKGROUND

The present disclosure relates to ladders and to platforms for ladders. More particularly, the present disclosure relates to a platform configured to be coupled to rungs of the ladder.

SUMMARY

In accordance with the present disclosure, a ladder comprises a first frame assembly and a second frame assembly coupled to the first frame assembly for pivotable movement relative to the first frame assembly between a deployed extension-ladder mode and a deployed step-ladder mode. Each frame assembly includes frame members interconnected by a plurality of rungs. A platform is configured to be coupled to rungs of a ladder whether the ladder is deployed in the extension-ladder mode or the step-ladder mode.

In an illustrative embodiment, the platform includes a platform step configured to be coupled to a lower rung of the ladder and further includes a step hanger comprising one or more hanger bars configured to be coupled to an upper rung of the ladder.

In an illustrative embodiment, the platform includes a platform step, one or more hanger bars, and a cross bar coupled to the one or more hanger bars and mounted on the platform step. The platform further includes a level adjuster or cross bar blocker unit coupled to the platform step. The cross bar blocker unit, cross bar and one or more hanger bars cooperate to selectively adjust a position of the platform step to maintain the platform step in an essentially level position relative to the surface upon which the ladder is deployed, whether in the extension-ladder mode or the step-ladder mode. In an illustrative embodiment, each cross bar blocker unit includes a first motion-limiter surface to limit upward motion of the cross bar in the extension-ladder mode and a second motion-limiter surface to limit upward motion of the cross bar in the step-ladder mode.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a perspective view of a platform in accordance with the present disclosure coupled to a ladder to provide a place for a user to stand as suggested in FIG. 4 and configured to be coupled to rungs of a ladder deployed in an "extension-ladder" mode as shown in FIG. 4 or a "step-ladder" mode as shown in FIG. 5;

FIG. 2 is a perspective view of the platform of FIG. 1 in an unfolded configuration apart from a ladder, the platform including a platform step configured to mate with a lower rung on a ladder and a step hanger including a cross bar (shown in phantom) mounted on the platform step for rotation about a pivot axis (also shown in phantom) and a pair of hanger bars coupled to the cross bar to rotate therewith and configured to mate with an upper rung on a ladder;

FIG. 3 is a rear view of the unfolded platform of FIG. 2 showing a pair of spaced-apart cross bar blocker units coupled to the platform step and arranged to mate with the cross bar as suggested in FIGS. 11 and 18 to block upward movement of the cross bar relative to the platform step when the platform is mounted on the ladder;

DETAILED DESCRIPTION

Figure 6:
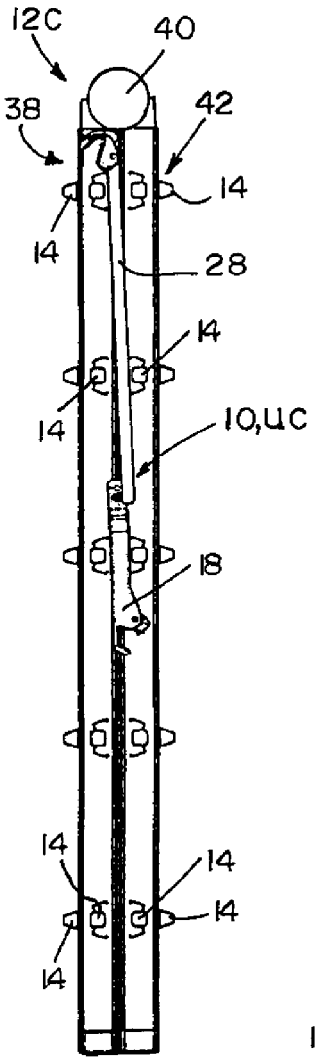
FIG. 6 is an enlarged sectional view of the ladder shown in FIGS. 4 and 5 after that ladder has been folded further to assume a collapsed, storage mode and showing that the platform has been reconfigured to assume the unfolded position shown in FIGS. 2 and 3 and the hanger bars are mated with a rung on the folded ladder to support the unfolded platform between two sections of the folded ladder.

In general terms but particularly referring to FIGS. 1-5, 11, and 18, the present disclosure relates to a ladder 12 including a first frame assembly 11A and a second frame assembly 11B coupled to the first frame assembly 11A for pivotable movement relative to the first frame assembly 11A between a deployed extension-ladder mode 12A and a deployed step-ladder mode 12B. Each frame assembly 11A, 11B includes a pair of frame members 110 having a plurality of rungs 14 interconnecting the frame members 110. Platform 10 is configured to be detachably coupled to rungs 14 of ladder 12 whether ladder 12 is deployed in extension-ladder mode 12A or step-ladder mode 12B. Platform 10 includes a platform step 18 and mounting means, or means for detachably mounting the platform step to the ladder 12, coupled to platform step 18 configured to detachably couple platform step 18 to a lower rung 20 and an upper rung 30 to provide a place for a user 16 to stand on or for items to be placed upon. The mounting means, or detachable mounting means, comprises a cross bar 24 coupled to one or more hanger bars 28, shown, for example, as a pair of hanger bars and configured to be coupled to upper rung 30. The mounting means further comprises a connector assembly 54 coupled to the one or more hanger bars 28 and configured to mate with upper rung 30 and also comprises another connector assembly 54 coupled to platform 18 and configured to mate with lower rung 20.

When ladder 12 is deployed in extension-ladder mode 12B, it leans against a structure 34 at, for example, angle $\alpha$. When ladder 12 is deployed in step-ladder mode 12B, it opens at, for example, angle $\beta$. The differing angles $\alpha$ and $\beta$ make it necessary to be able to adjust platform 10 to maintain platform step 18 in an essentially level position relative to a surface 36 upon which ladder 12 is deployed. To maintain platform step 18 in an essentially level position relative to surface 36, the angle of platform 10, shown, for example, as angles $\gamma_1$ and $\gamma_2$, relative to, for example, frame assemblies 11B and 11A, respectively, must be changed to be substantially equal to angle $\Delta_1$ or $\Delta_2$, respectively, between frame assemblies 11B, 11A and surface 36 (see FIGS. 4 and 5). Accordingly, platform 10 further comprises adjuster means or one or more level adjusters 32, shown, for example, as a pair of cross bar blocker units. Cross bar 24 and cross bar blocker units 32 are coupled to an underside 52 of platform step 18.

In illustrative embodiments, each cross bar blocker unit 32 includes a base 84, a slider 86 and an elongated slot 106 associated with both base 84 and slider 86. Slider 86 includes a body 87, a finger portion 104 coupled to and extending outwardly from a first end 89 of body 87, and a plunger portion 91 coupled to and extending outwardly from a second end 93 of body 87. Plunger portion 91 includes a neck 95 and a handle 97 coupled to neck 95 to accommodate a user's finger 131 for movement of slider 86.

Figure 11:
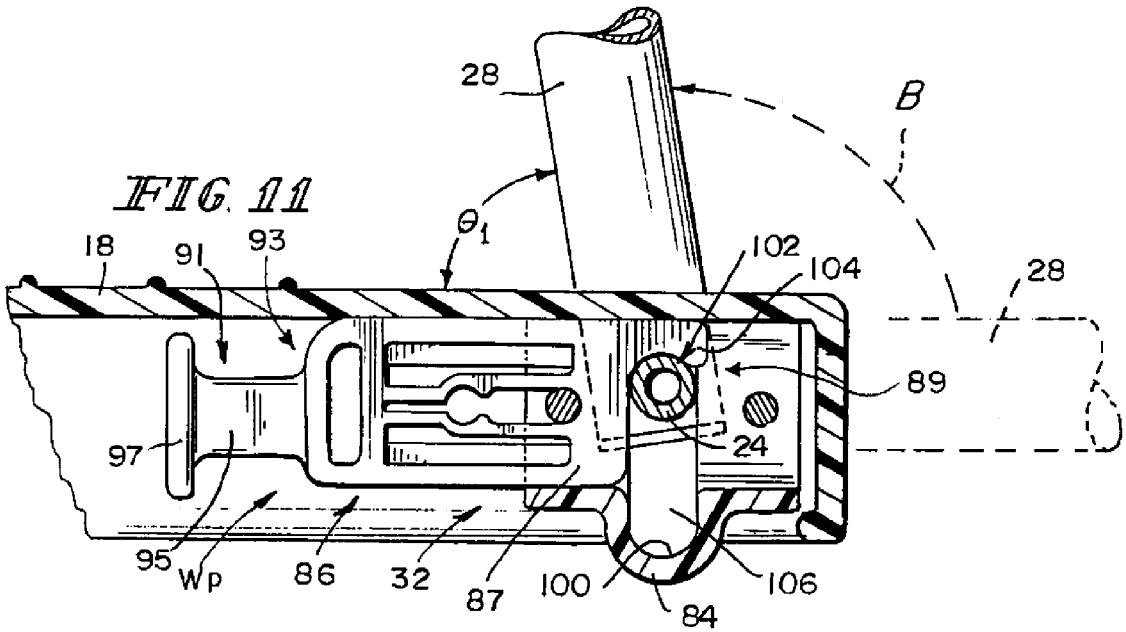
FIG. 11 is a sectional view similar to FIG. 10 showing that the hanger bars have been lifted to raise the cross bar in an upward direction out of the cross bar-receiver channel formed in the base into a vertical slot formed in the base to a "raised" position to engage the curved upper motion-limiter surface provided on the finger of the slider while the hanger bars have been rotated in a counterclockwise direction about the pivot axis through pivot angle B to orient the hanger bars at a first angle relative to the platform step as shown, for example, in FIGS. 1 and 4 to facilitate mounting of the platform on upper and lower rungs of a ladder in extension-ladder mode.

To maintain platform step 18 in the level position in the extension-ladder mode 12A, finger portion 104 and elongated slot 106 cooperate to form an upper motion-limiter surface 102 to limit upward movement of cross bar 24 when slider 86 is in a withdrawn position $W_p$ (see FIG. 11). Platform step 18 will be kept in place by, for example, the gravity pull of its own weight and the hanger bar 28 coupled to rung 30. To maintain platform step 18 in the level position in the step-ladder mode 12B, a lower portion 134 of slider 86 forms an upper motion-limiter surface 132 to limit upward movement of cross bar 24 when slider 86 is in an inserted position $I_p$. Cross bar blocker unit 32 also includes a detent 136 and a groove 138 on slider 86 and a lock pin 80 on a base 84. Lock pin 80 is configured to move in groove 138 and to snap into detent 136 to lock slider 86 in a fixed position over cross bar 24 (see FIG. 18) and to keep platform step 18 in place.

In more detailed terms and in accordance with the present disclosure, a platform 10 is configured to be coupled to a ladder 12, as shown in FIG. 1. Platform 10 is further configured to be coupled to rungs 14 of ladder 12 to provide a place for a user 16 to stand on, as suggested in FIG. 4, whether ladder 12 is deployed in an "extension-ladder" mode 12A, as shown, for example, in FIG. 4, or in a "step-ladder" mode 12B, as shown, for example, in FIG. 5.

Platform 10 is shown in FIG. 2 in an unfolded configuration UC apart from ladder 12. Platform 10 includes platform step 18 configured to mate with lower rung 20 on ladder 12 and further includes a step hanger 22 including cross bar 24 (shown in phantom) mounted on platform step 18 for rotation about a pivot axis 26 (shown in phantom). Step hanger 22 also includes one or more hanger bars 28, shown as the pair of hanger bars 28, coupled to cross bar 24 and configured to rotate with cross bar 24 and mate with upper rung 30 on ladder 12.

As shown in FIG. 3, a rear view of platform 10 in unfolded configuration UC, one or more cross bar blocker unit 32, shown as the pair of spaced-apart cross bar blocker units, is coupled to platform step 18. As noted above and as discussed more fully below, cross bar blocker units 32 are arranged to mate with cross bar 24, as suggested in FIGS. 11 and 18, to block upward movement of cross bar 24 relative to platform step 18 when platform 10 is mounted on ladder 12.

Figure 4:
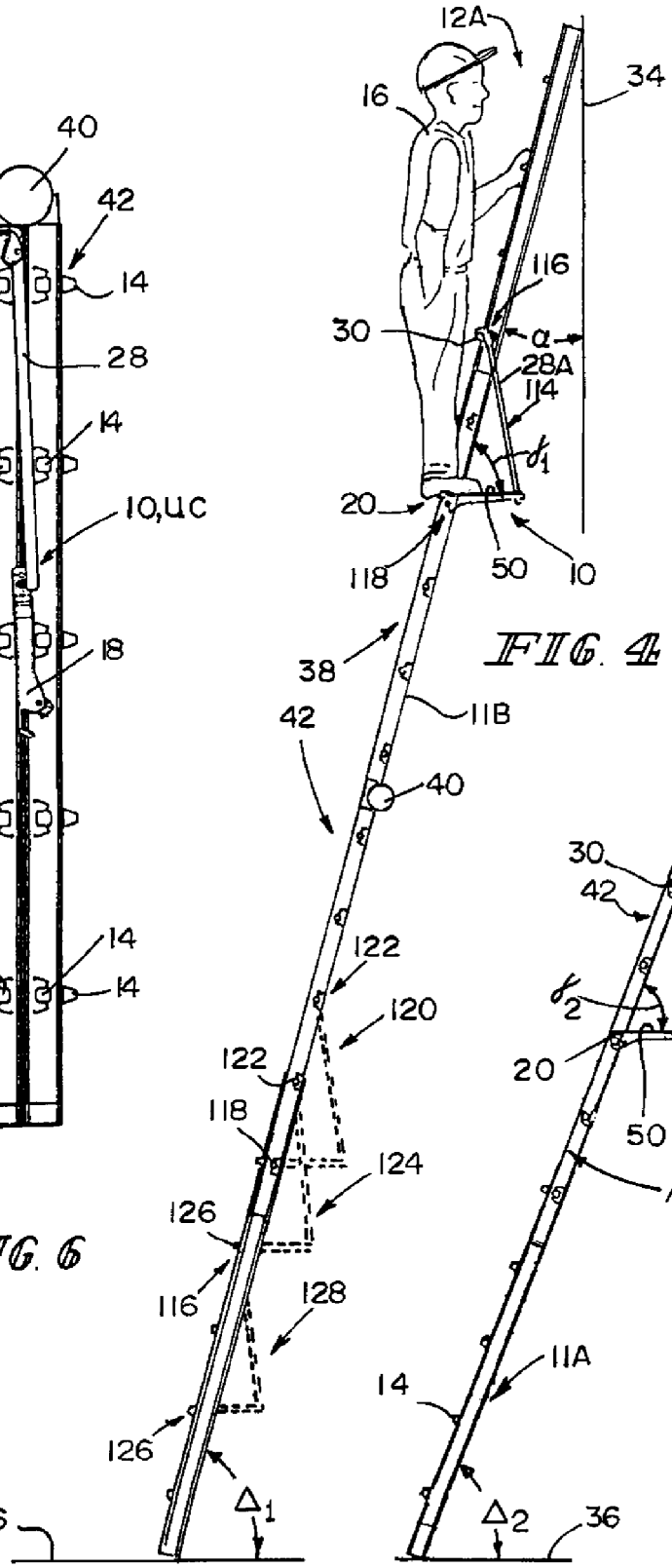
FIG. 4 is a sectional view of the ladder and platform of FIGS. 1-3 taken along line 4-4 of FIG. 1 mounted on a ladder deployed in an "extension-ladder" mode.
Figure 5:
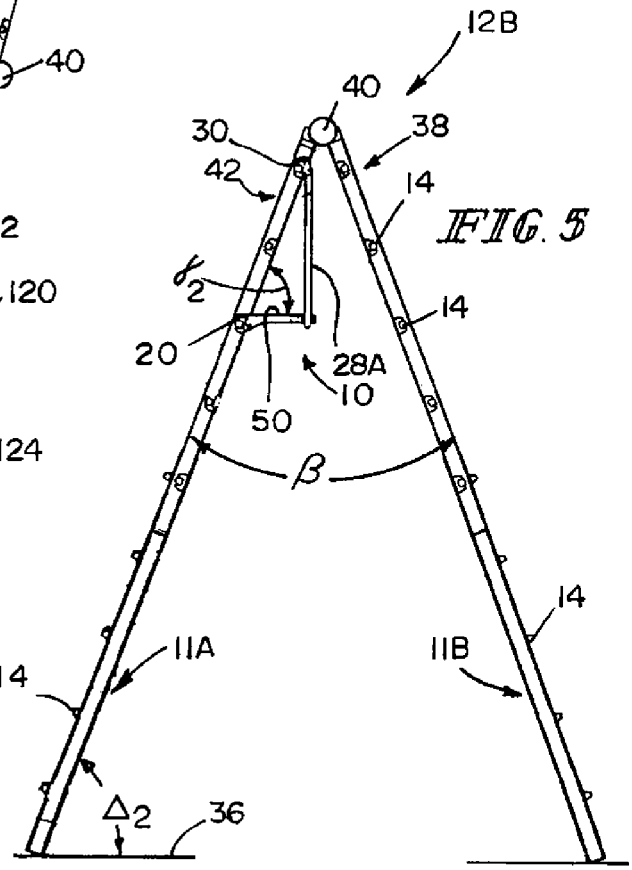
FIG. 5 is a view similar to FIG. 4 showing a platform mounted on the ladder of FIG. 4 after that ladder has been folded and deployed in a "step-ladder" mode.

Platform 10 and ladder 12 are shown in FIGS. 4-6 in three different modes. As shown in FIG. 4, platform 10 is mounted on ladder 12 deployed in extension-ladder mode 12A such that ladder 12A is leaning against structure 34 at an angle $\alpha$ and is supported on surface 36. As shown in FIG. 5, platform 10 is mounted on ladder 12 deployed in step-ladder mode 12B. Step-ladder mode 12B was achieved, for example, by folding an upper ladder section 38 about a pivot joint 40 relative to a lower ladder section 42 to form step-ladder 12B having upper and lower ladder sections 40, 42 supported on surface 36 and separated at angle β. As noted above, the difference between angles α and β necessitates that platform 10 be adjustable such that platform step 18 can be maintained in an essentially level or parallel position relative to surface 36 when ladder 12 is deployed in extension-ladder or step-ladder mode 12A 12B, as suggested in FIGS. 10-11 and 16-18, respectively. As shown in FIG. 6, platform 10 is configured in the unfolded configuration UC (see FIGS. 2 and 3) and supported between folded ladder sections 38, 42 forming a folded ladder in a collapsed, storage mode 12C.

Figure 7:
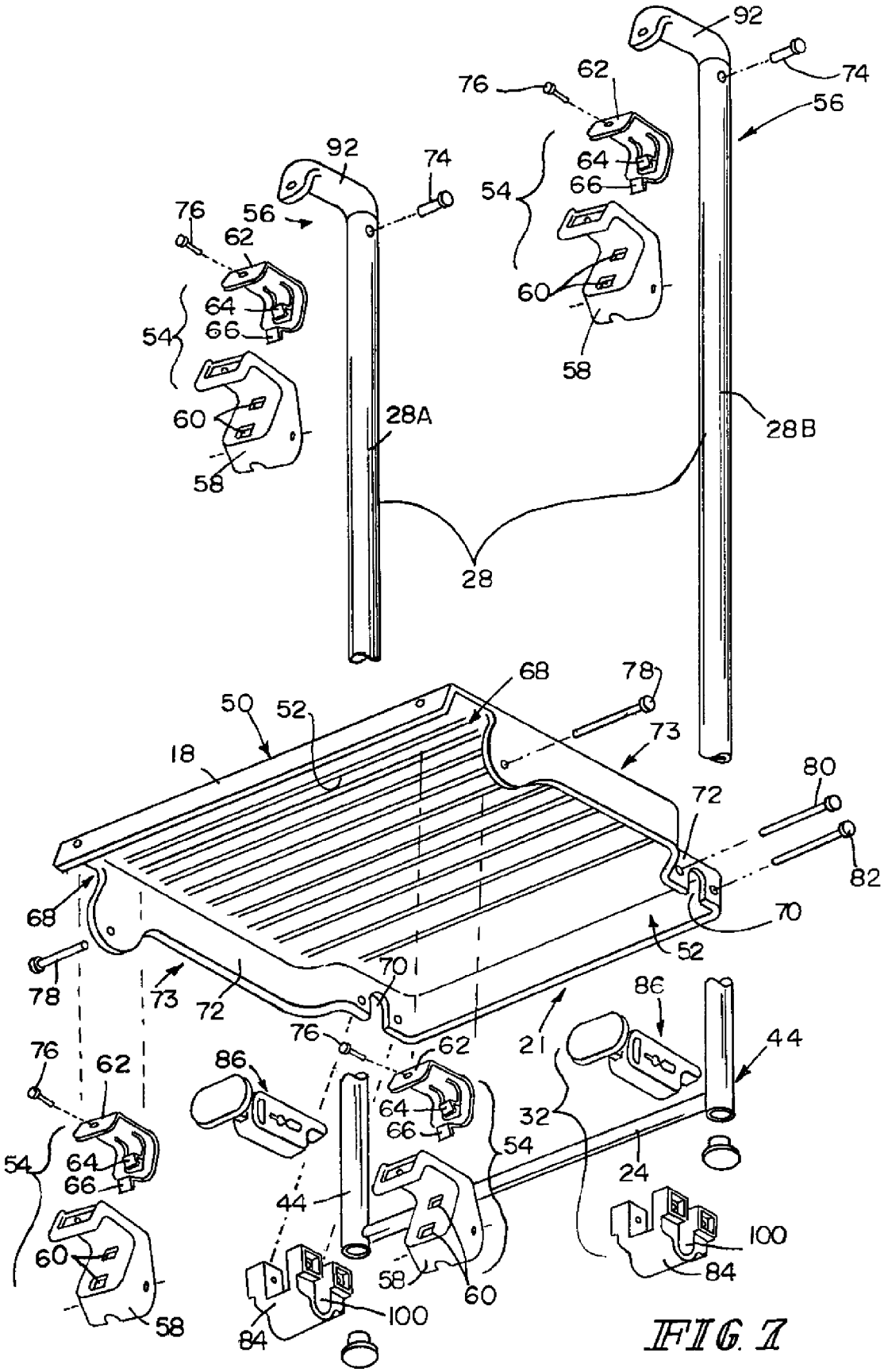
FIG. 7 is an exploded perspective view of components included in the platform shown in FIGS. 2 and 3 showing the cross bar coupled to lower ends of the first and second hanger bars.

As shown in FIG. 7, platform 10 comprises platform step 18, cross bar 24, and the pair of hanger bars 28 coupled to cross bar 24. Hanger bars 28, for illustrative purposes, are further designated as first and second hanger bars 28A and 28B and which designations may be used interchangeably herein. Cross bar 24 is coupled to lower ends 44 of each hanger bar 28A, 28B. As shown in FIGS. 2 and 3, a cross member 46 is coupled to upper ends 48 of each hanger bar 28A, 28B. Platform 10 further comprises a stepping or storage or top surface 50, bottom surface 51, a lip 72 interconnecting surfaces 50 and 51 and cooperating to form underside area 52, as shown in FIG. 7. Platform 18 also includes a front end 19 and a rear end 21 interconnected by surfaces 50 and 51.

Figure 8:
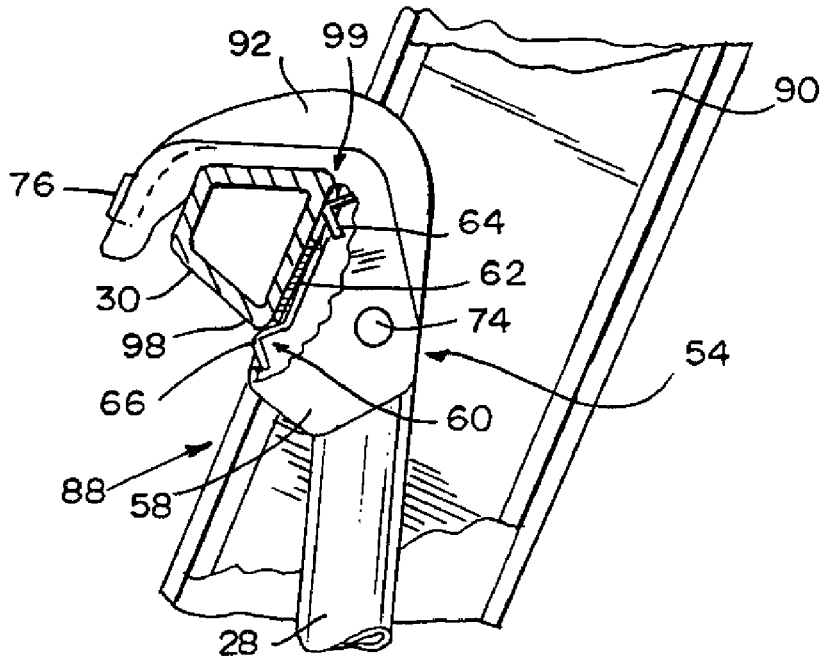
FIG. 8 is a sectional view taken along line 8-8 of FIG. 1 showing mating engagement of one of the hanger bars included in the step hanger with an upper rung of the ladder.
Figure 13:
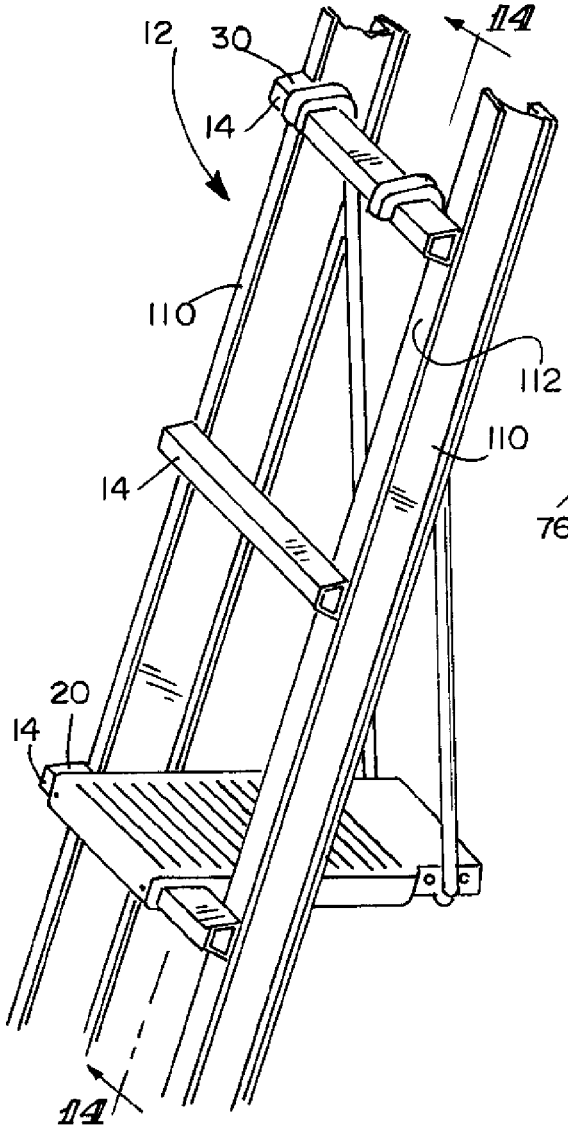
FIG. 13 is a perspective view of the platform of FIGS. 2 and 3 mounted in a lower position on the bottom ladder section shown in FIG. 4.
Figure 20:
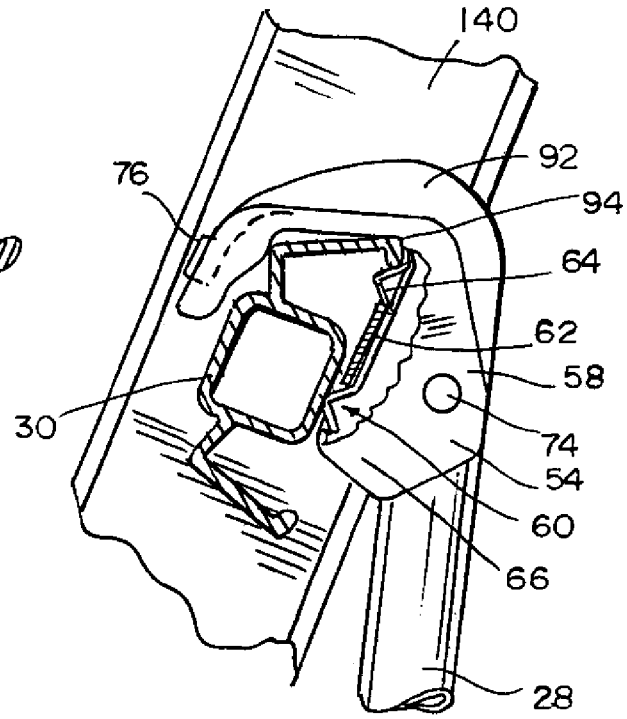
FIG. 20 is a sectional view taken along line 20-20 of FIG. 15 showing mating engagement of one of the hanger bars included in the step hanger with an upper rung of the ladder.

Each hanger bar 28A, 28B comprises a connector assembly 54 at an upper end 56, as shown in FIG. 1. Each connector assembly 54 includes a hook 58 having openings 60 and a catch 62 having upper and lower spring tabs 64, 66, respectively, and connector assembly 54 is configured to mate with upper rungs 30, as shown in FIGS. 8, 13 and 20. Spring tabs 64, 66 may be made of metal or other materials adapted to perform as spring-like elements.

Platform step 18 also includes a rung receiver channel 68 located at front end 19 of platform step 18 and formed in lip 72 on opposing sides 73 of platform step 18. Rung receiver channel 68 is configured to receive and have mounted therein two connector assemblies 54 configured to mate with lower rung 20, as shown in FIGS. 1, 19, 14 and 21. Rung receiver channel 68 is also configured to receive a portion of lower rung 20 when platform 10 is mounted on ladder 12, as shown in FIGS. 1, 9, 14 and 21.

As further shown in FIG. 7, platform step 18 includes a cross bar receiver channel 70 located at rear end 21 of platform step 18 and formed in lip 72 on opposing sides 73 of platform step 18. Cross bar receiver channel 70 is configured to receive cross bar 24 when platform 10 is deployed in extension-ladder mode 10A. Connector assembly 54 is coupled to upper end 56 of each hanger bar 28A, 28B by a connector 74, shown, for example, as a rivet. Hook 58 is coupled to catch 62 by connector 76, shown, for example, as a rivet. Connector assembly 54 is coupled to platform step 18 by connector 78, shown, for example, as a rivet.

For maintaining platform 18 in an essentially level position or on a parallel plane with respect to surface 30 when ladder 10 is deployed in extension ladder mode 12A or step-ladder mode 12B, platform 10 further includes cross bar blocker units 32 coupled to underside area 52 of platform step 18 by a first connector 80 which may, for example, be a pin or a rivet, and second connector 82 which may, for example, be a pin or a rivet. Each cross bar blocker unit 32 includes base 84, slider 86 and elongated slot 106 configured to receive a portion of cross bar 24, as suggested in FIG. 7 and further shown, for example, in FIGS. 10 and 11. Base 84, slider 86, and slot 106 cooperate to allow positioning of cross bar 24 such that platform step 18 will be maintained in an essentially level position on a plane essentially parallel with respect to surface 36 when ladder 10 is deployed in either extension-ladder mode 12A or step-ladder mode 12B, as suggested in FIGS. 4, 5, 11 and 18.

With regard to extension-ladder mode 12A, as shown, for example, in FIG. 1, a mating engagement of one of the hanger bars 28 coupled to upper rung 30 is shown in FIG. 8. Upper rung 30 is shown mounted on a portion 88 of a frame member 90 of ladder 12A. Hanger bar 28 includes a hanger bar extension 92 and connector assembly 54 coupled to hanger bar extension 92 by rivet 74. Connector assembly 54 includes hook 58 having openings 60 therethrough and catch 62 having upper and lower metal spring tabs 64, 66 protruding through openings 60. As shown in FIG. 8, when connector assembly 54 mates with upper rung 30, lower metal spring tab 66 engages with a lower corner 98 of upper rung 30 such that lower metal spring tab 66 snaps into cooperative engagement with lower corner 98 thereby releasably securing hanger bar 28 to upper rung 30. Upper metal spring tab 64 lies in contact with and adjacent to an upper corner 99 of upper rung 30.

Figure 9:
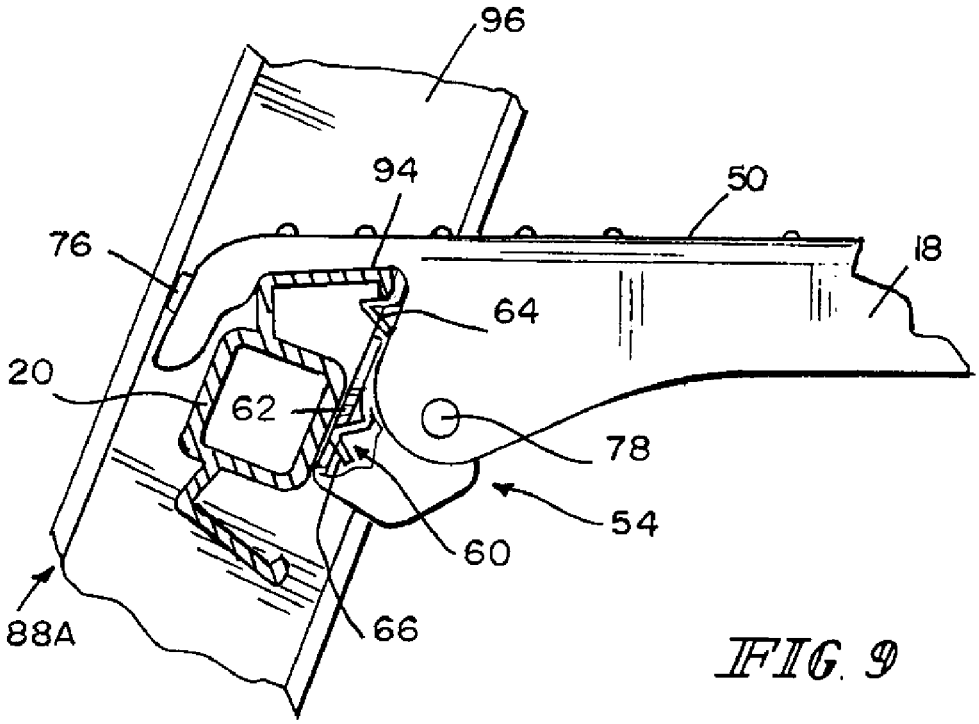
FIG. 9 is a sectional view taken along line 9-9 of FIG. 1 showing mating engagement of the platform step included in the platform with a lower rung of the ladder.

With further regard to extension-ladder mode 12A, as shown, for example, in FIG. 1, a mating engagement of platform step 18 coupled to lower rung 20 is shown in FIG. 9. Lower rung 20 is shown mounted on a portion 88A of frame member 96 of ladder 12A. Platform step 18 includes connector assembly 54 coupled together by rivet 78. Connector assembly 54 includes hook 58 having openings 60 therethrough and catch 62 having upper and lower metal spring tabs 64, 66 protruding through openings 60. As shown in FIG. 9, when connector assembly 54 mates with lower rung 20, upper metal spring tab 64 engages a rung extension 94 of rung 20 such that upper metal spring tab 64 snaps into cooperative engagement with rung extension 94 thereby releasably securing platform step 18 to lower rung 20. Lower metal spring tab 66 lies in contact with and adjacent lower rung 20.

Figure 10:
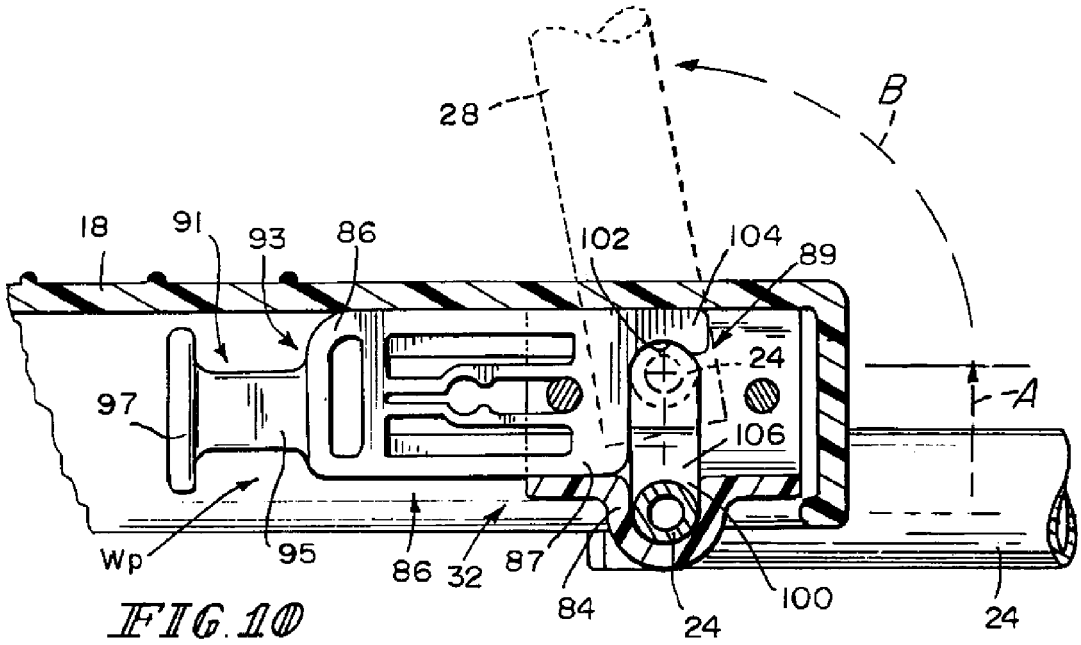
FIG. 10 is an enlarged sectional view taken along line 10-10 of FIG. 3 showing that the first cross bar blocker unit includes a base formed to include a cross bar-receiver channel containing the cross bar and a slider mounted for sliding movement relative to the base and the platform step and showing that the slider has been moved (to the left) to assume a "withdrawn" position relative to the base wherein a curved upper motion-limiter surface provided on a finger included in the slider is arranged to overlie the cross bar located in the bar-receiver channel formed in the base.
Figure 12:
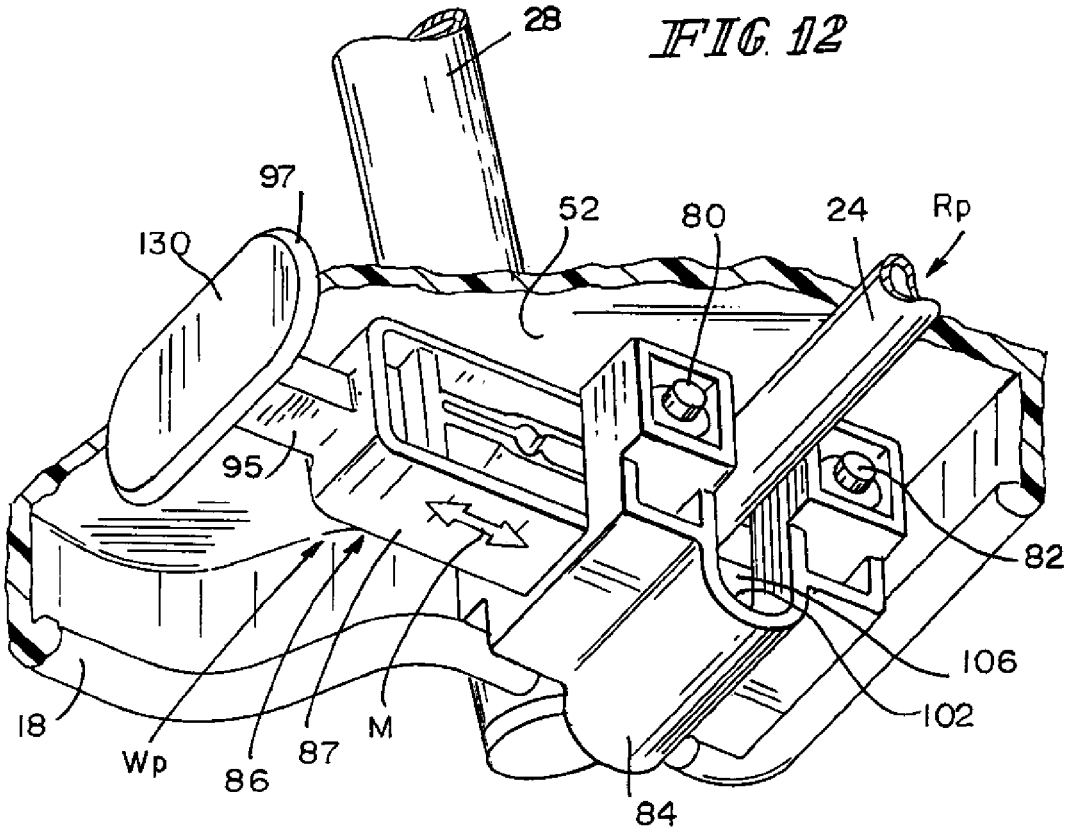
FIG. 12 is a perspective view of a portion of the underside of the platform of FIG. 11 showing the raised position of the cross bar in the vertical slot formed in the base.

The structure and operation of cross bar blocker unit 32 and step hanger 22, related to ladder 12 when deployed in extension-ladder mode 12A, is shown in FIGS. 10-12. As shown in FIG. 10, platform 10 is in the unfolded configuration UC. Cross bar blocker unit 32 includes base 84 that is formed to include a cross bar receiver channel 100, configured to receive cross bar 24. Cross bar blocker unit 32 further includes slider 86, mounted for sliding movement relative to base 84 and platform step 18. As shown in FIG. 10, slider 86 has been moved to the left (viewing FIG. 10) to assume a "withdrawn" position $W_p$ relative to base 84. Consequently, an upper motion-limiter surface 102, on finger 104 of slider 86, is arranged to overlie cross bar 24 located in cross bar-receiver channel 100 formed in base 84.

To place platform 10 in a configuration to be mounted on ladder 12 in extension-ladder mode 12A, hanger bars 28 are raised through distance A (see FIG. 10) so that hanger bars 28 are moved out of cross bar receiver channel 100 into vertical slot 106 in base 86 and then into engagement with upper motion-limiter surface 102, as suggested in phantom in FIG. 10 and shown in FIG. 11. Hanger bars 28 are then rotated counter-clockwise and toward upper motion-limiter surface 102 through pivot angle B and thus lifted out of cross bar receiver channel 100 to engage upper motion-limiter surface 102, as suggested, in phantom, in FIG. 10 and shown in FIG. 11.

As shown in FIG. 11, hanger bars 28 have been lifted to raise cross bar 24 in an upward direction out of cross bar receiver channel 100 within vertical slot 106 to a "raised position" $R_p$ to engage upper motion-limiter surface 102, on finger 104 of slider 86. Hanger bars 28 have been rotated through pivot angle B to orient hanger bars 28 at a first angle $\theta_1$ relative to platform step 18 (see, for example, FIGS. 1 and 4) to facilitate mounting of platform 10 on upper and lower rungs 30, 20 of ladder 12 in extension-ladder mode 12A.

A different perspective of platform 10 configured as shown in FIG. 11 is shown in FIG. 12, where a portion of underside area 52 reveals that cross bar 24 is in the raised position $R_p$ in vertical slot 106 formed in base 84 of cross bar blocker unit 32. Base 84 is coupled to platform step 18 by first and second pins or rivets 80, 82. Slider 86 is shown in the withdrawn position $W_p$ but configured to be movable, as suggested by arrow M.

Relative to platform 10 mounted to ladder 12 in extension ladder mode 12A, after hanger bars 28 are coupled to upper rung 30 and platform step 18 is coupled to lower rung 20, cross bar 24 will remain engaged and lodged against upper motion-limiter surface 102. Such a position of cross bar 24 is essentially due to gravity related to the weight of platform step 18 and that upper ends 56 of hanger bars 28 are coupled to upper rung 30 and cross bar 24 is coupled to hanger bars 28.

Figure 14:
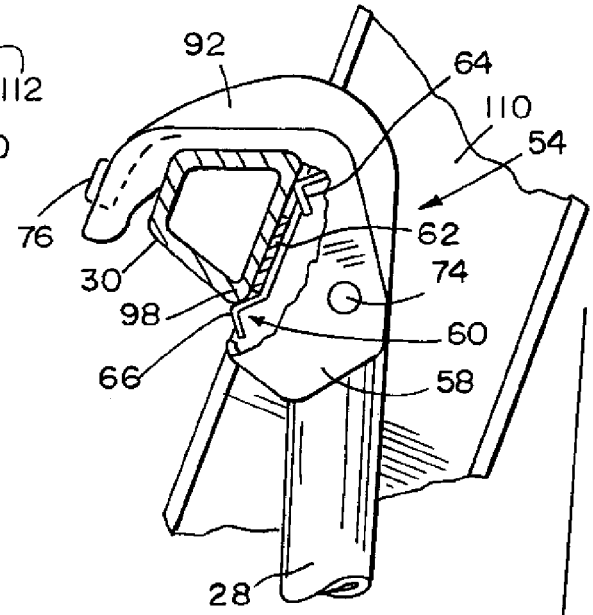
FIG. 14 is a partial sectional view taken along line 14-14 of FIG. 13.
Figure 14:
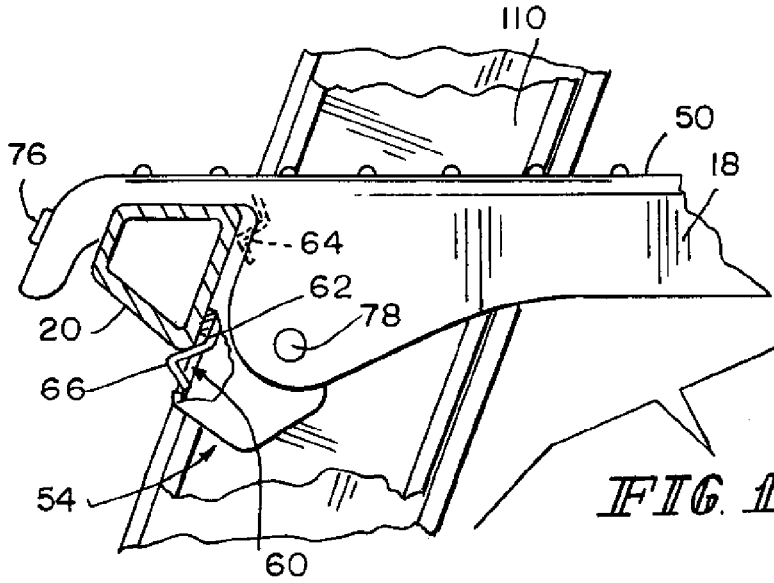

Up until this point, rungs 14 of ladder 12 have been referred to as either lower rungs 20 or upper rungs 30. Now it is worthwhile to consider how platform 10 can be mounted on a ladder 12 whether rungs 14 are on an inside surface 108 of a ladder frame member 110 in an "inside" configuration, as shown in FIG. 1, or on an outside surface 112 of ladder frame member 110 in an "outside" configuration, as shown in FIGS. 1 and 13. Platform 10 is configured such that it can be mounted to ladders 12, 12A, 12B, whether upper or lower rungs 30, 20 are mounted on the inside surface 108 or outside surface 112. For example, as shown in FIGS. 1, 8, and 9, platform 10 is mounted to upper rung 30 that is on an outside surface 112 and to lower rung 20 that is on an inside surface 110. However, as shown in FIGS. 13 and 14, platform 10 is mounted on upper rung 30 on outside surface 112 and on lower rung 20 on outside surface 112. Thus, an "inside" configuration is where rung 14 is mounted on interior surface 108 entirely between spaced-apart frame members 110 and an "outside" configuration is where rung 14 is mounted on outside surfaces 112 of spaced-apart frame members 110.

Any combination of rungs 14 and mounting combinations of rung configurations (upper, lower, inside, and outside) is possible. For example, in FIG. 4 platform 10 is shown mounted in four positions on ladder 12A. At the highest position 114, platform 10 is mounted on an upper outside rung 116 and a lower inside rung 118, shown in perspective in FIG. 1. At a first intermediate position 120, shown in phantom, platform 10 is mounted on an upper inside rung 122 and lower inside rung 118, as shown in perspective in FIG. 15. At a second intermediate position 124, shown in phantom, platform 10 is mounted on upper inside rung 122 and a lower outside rung 126. And, finally, at the lowest position 128, shown in phantom, platform 10 is mounted on upper outside rung 116 and lower outside rung 126, as shown in perspective in FIG. 13. The mounting of platform 10 in the various combinations and configurations discussed herein is made possible by platform 10 having hanger bars 28 configured to pivot relative to platform step 18. The mounting of platform 10 can be on a single extension ladder or on different ladder sections, as suggested in FIG. 4.

Figure 15:
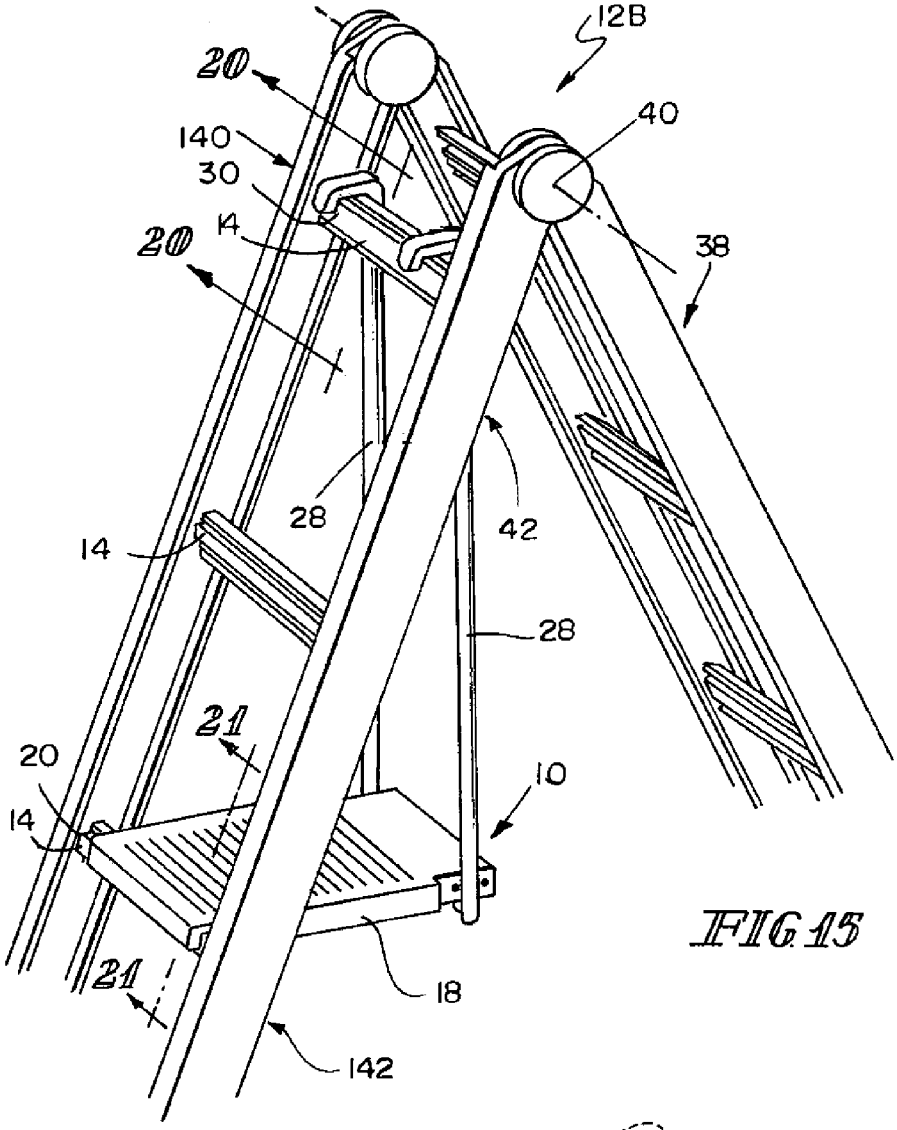
FIG. 15 is a perspective view of the platform of FIGS. 2 and 3 coupled to a ladder deployed in a stepladder mode.

A perspective view of ladder 10 deployed in step-ladder mode 12B of FIG. 5 is shown in FIG. 15. Step ladder mode 12B was achieved by rotation of ladder sections 38, 42 relative to one another about pivot joint 40. Platform 10 is shown mounted on upper rung 30 and lower rung 20.

Figure 16:
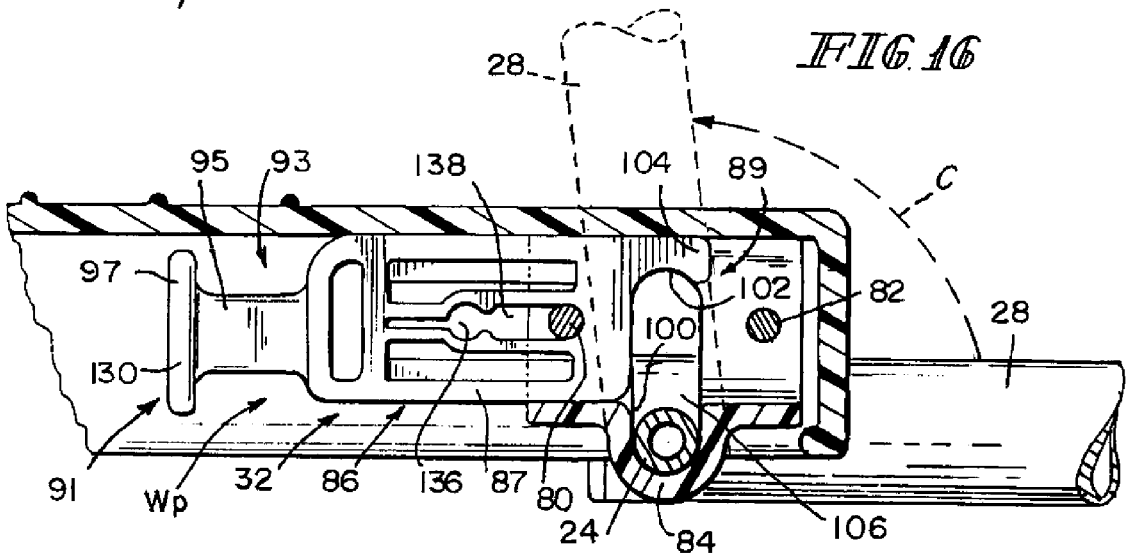
FIG. 16 is a sectional view taken along line 16-16 of FIG. 3 showing that the first cross bar blocker unit includes a base formed to include a bar-receiver channel containing the cross bar and a slider mounted for sliding movement relative to the base and the platform step and showing that the slider has been moved (to the left) to assume a "withdrawn" position relative to the base wherein a curved upper motion-limiter surface provided on a finger included in the slider is arranged to overlie the cross bar located in the bar-receiver channel formed in the base.

The structure and operation of cross bar blocker unit 32 and step hanger 22 related to ladder 12 when deployed in step-ladder mode 12A is shown in FIGS. 16-19. As shown in FIG. 16, cross bar blocker unit 32 includes base 84 that is formed to include cross bar receiver channel 100 configured to receive cross bar 24. Cross bar blocker unit 32 further includes slider 86 mounted for sliding movement relative to base 84 and platform step 18. As shown in FIG. 16, slider 86 has been moved to the left (viewing FIG. 16) to assume the "withdrawn" position $W_p$ relative to base 84. Consequently, upper motion-limiter surface 102 on finger 104 of slider 86 is arranged to overlie cross bar 24 located in cross bar receiver channel 100 formed in base 84.

Figure 17:
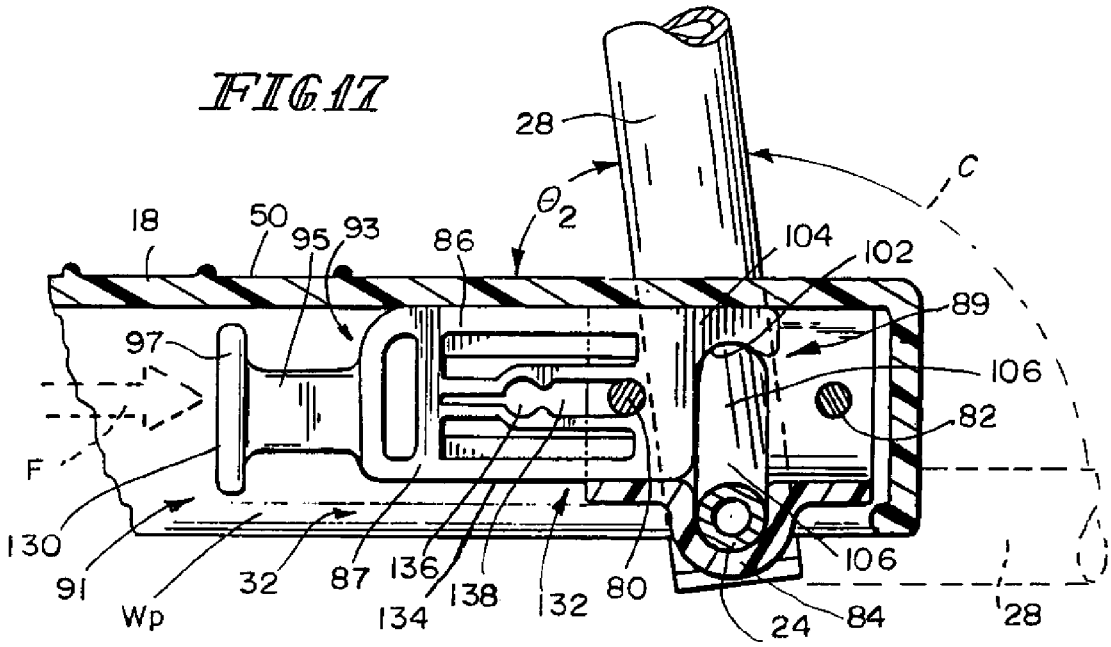
FIG. 17 is a sectional view similar to FIG. 16 showing that the hanger bars have been pivoted about the pivot axis through a pivot angle C to orient the hanger bars at a second angle relative to the platform step as shown, for example, in FIGS. 5 and 15, to facilitate mounting on the platform on upper and lower rungs of a ladder in a stepladder mode.

To place platform 10 in a configuration to be mounted on ladder 12 in step-ladder mode 12B, hanger bars 28 are pivoted about pivot axis 26 (see FIGS. 2 and 3) through pivot angle C, as suggested in FIG. 16 and shown in FIG. 17. Such pivoting orients hanger bars 28 at a second angel $\theta_2$ relative to platform step 18, as suggested in FIGS. 5 and 15 and shown in FIG. 17. Such orientation of hanger bars 28 facilitates mounting platform 10 on upper and lower rungs 30, 20 on ladder 12 in step-ladder mode 12B. However, to maintain platform step 18 in an essentially level plane relative to surface 36 (see, for example, FIGS. 5 and 15) when ladder 10 is deployed in step-ladder mode 12B, further manipulation of cross bar blocker unit 32 is needed to limit upward movement of cross bar 24.

Figure 18:
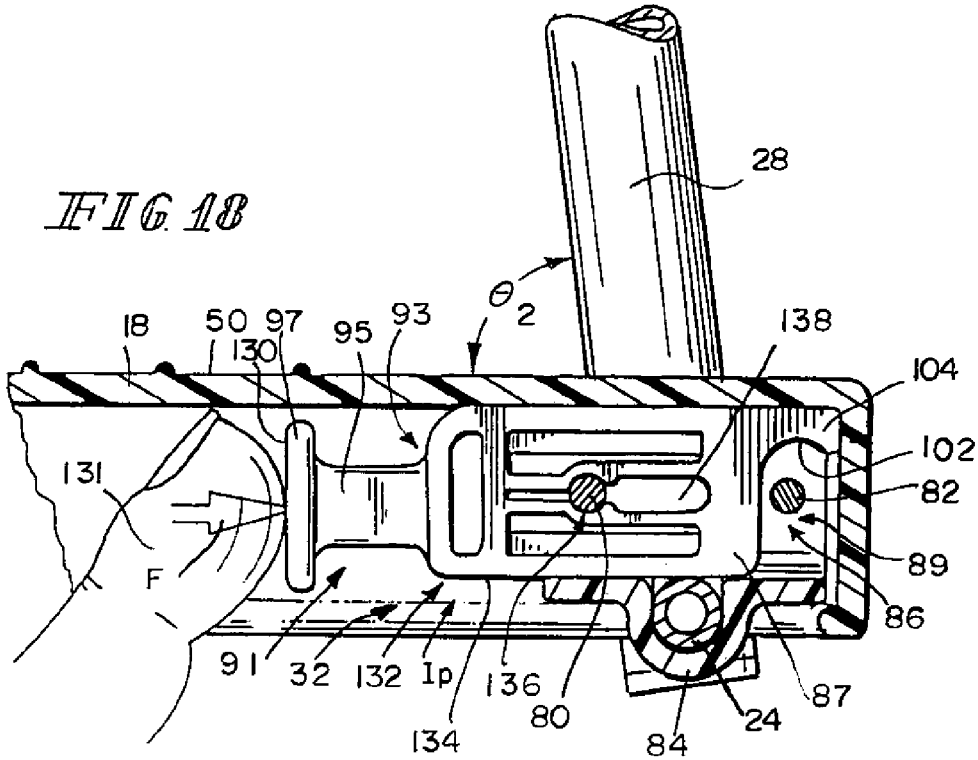
FIG. 18 is a sectional view similar to FIGS. 16 and 17 showing movement of the slider relative to the base and the platform step to assume an "inserted" position relative to the base wherein a flat lower motion-limiter surface provided on a bottom edge of the slider is arranged to overlie a cross bar located in the bar-receiver channel formed in the base and the slider is "locked" in a fixed position relative to the base by engagement of a detent included in the slider with a lock pin included in the base.

As suggested by force arrow F, in phantom in FIG. 17, slider 86 is configured to be moved from the withdrawn position $W_p$ to an "inserted" position $I_p$, as shown in FIG. 18. Thus, as shown in FIG. 18, slider 86 has been moved to the right (viewing FIG. 18) relative to base 84 and platform step 18 by, for example, a user's finger 131 pushing on outside surface 130 of slider 86. Slider 86 has assumed the inserted position $I_p$ relative to base 84 placing an upper motion-limiter surface 132 provided on lower portion 134 of slider 86 over cross bar 24. Thus, lower portion 134 is arranged to overlie cross bar 24 located in cross bar receiver channel 100 formed in base 84. When slider 86 assumes the inserted position $I_p$, slider 86 is "locked" in a fixed position relative to base 84 by engagement of detent 136 of slider 86 with lock pin or first rivet 80 included in base 84. As slider 86 moves between the withdrawn and insertion positions $W_p$, $I_p$, lock pin or first rivet 80 travels in groove 138 of slider 86.

Figure 19:
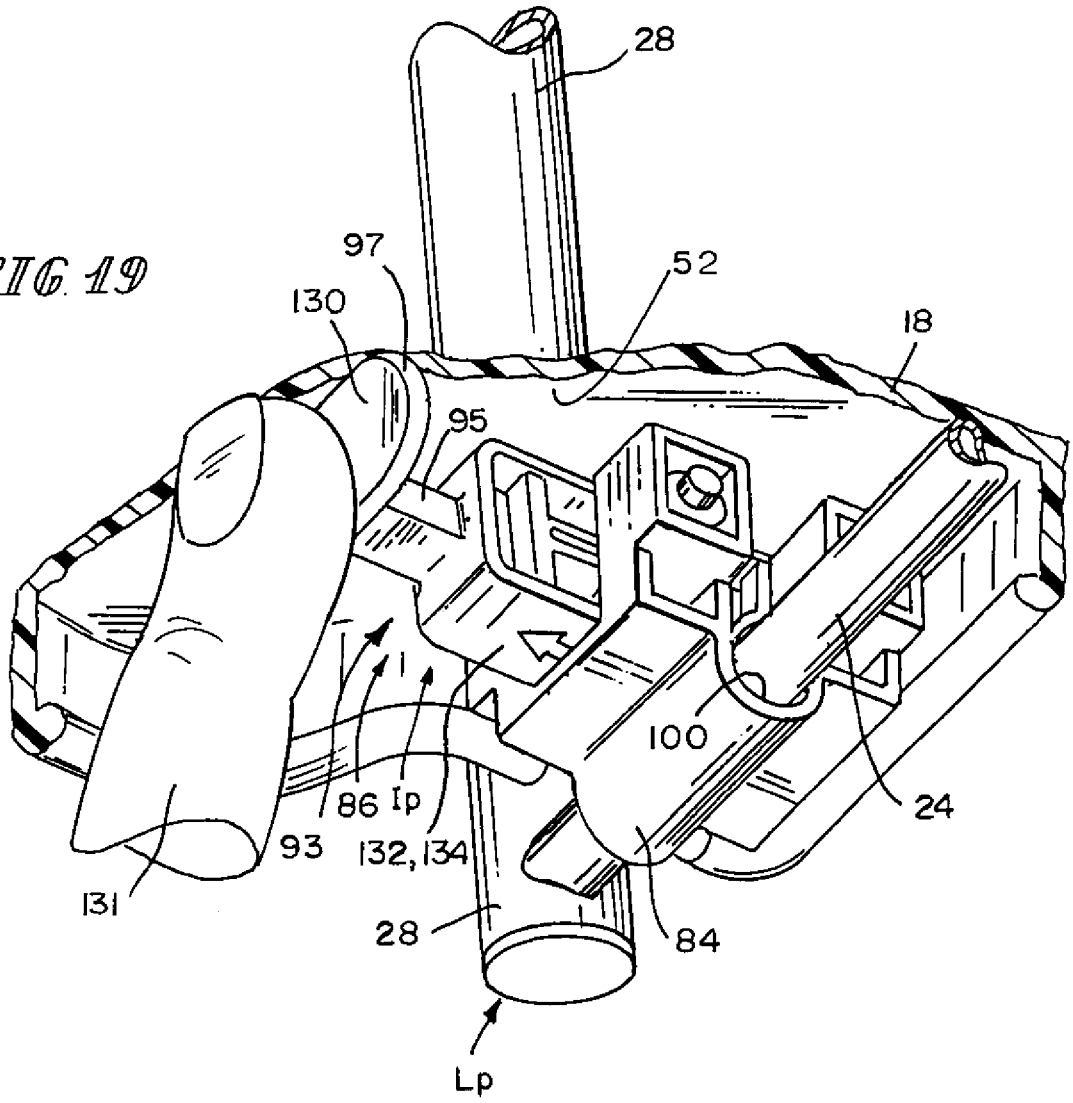
FIG. 19 is a perspective view of a portion of the underside of the platform showing the lowered position of the cross bar in the bar-receiver channel formed in the base and under the slider that has been moved to assume the inserted position in the base.

A different perspective of platform 10 configured as in FIG. 18 is shown in FIG. 19, where a portion of underside area 52 reveals cross bar 24 in the lowered position $L_p$ in cross bar receiver channel 100 formed in base 84. Cross bar 24 is under lower portion 134 of slider 86 which has been moved by user's finger 131 to assume the inserted position $I_p$ in base 84.

Figure 21:
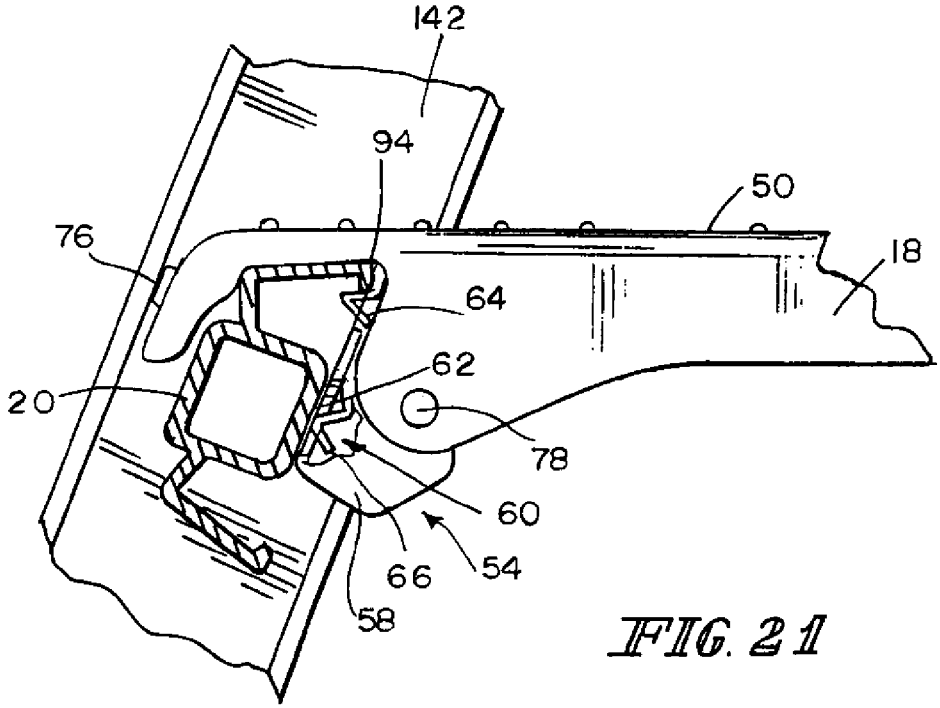
FIG. 21 is a sectional view taken along line 21-21 of FIG. 15 showing mating engagement of the platform step included in the platform with a lower rung of the ladder.

With further regard to step-ladder mode 12B, as shown, for example, in FIG. 15, portions of platform 10 are shown mounted to upper and lower ladder sections 140, 142 in FIGS. 20 and 21, respectively. As shown in FIG. 20, hanger bars 24 are coupled to upper rung 30 using the same connector assembly 54 structure and in the same manner as described herein regarding the mounting of platform step 18 to lower rung 20, as shown in FIG. 9. Likewise, as shown in FIG. 21, platform step 18 is coupled to lower rung 20 using the same connector assembly 54 structure and in the same manner as described herein regarding the mounting of platform step 18 to lower rung 20, as shown in FIG. 9.

The invention claimed is:

1. A ladder comprising a first frame assembly and a second frame assembly coupled to the first frame assembly for pivotable movement relative to the first frame assembly between a deployed extension-ladder mode and a deployed stepladder mode, each frame assembly including a pair of frame members having a plurality of rungs interconnecting the frame members, a platform including a platform step and means for detachably mounting the platform step on two rungs of the ladder, a level adjuster to selectively adjust a position of the platform step to maintain the platform step in an essentially level position relative to a surface upon which the ladder is deployed in either of the two deployed modes, and wherein the means for detachably mounting the platform step includes a hanger bar and a cross bar coupled to a first end of the hanger bar and mounted on the platform step, and further wherein the level adjuster includes a slider, a base and an elongated slot associated with both the slider and the base and configured to matingly receive the cross bar for rotational movement relative to the platform step and for vertical movement therein, and the slider is configured to allow the cross bar to move within the elongated slot in a first position of the slider and the slider and the base cooperate to lock the cross bar in the elongated slot in a second position of the slider.

2. The ladder of claim 1, wherein the slider includes a body, a finger portion coupled to and extending outwardly from a first end of the body, and a plunger portion coupled to and extending outwardly from a second end of the body, the finger portion cooperating with the elongated slot to form a first upper motion-limiter surface to limit upward movement of the cross bar when the slider is in the first position and a lower portion of the body forming a second upper motion-limiter surface to limit upward movement of the cross bar when the slider is in the second position.

3. The ladder of claim 1, wherein the base includes a lock pin to couple the base to the platform step and further includes a cross bar receiver channel configured to receive the cross bar, and the slider further includes a groove configured to receive the lock pin therethrough, the groove having a detent formed therein to releasably lock the slider in a fixed position over the cross bar when the cross bar is located in the cross bar receiver channel and the slider is in the second position.

4. The ladder of claim 2, wherein the plunger portion includes a neck and a handle coupled to the neck, and an exterior surface of the handle is configured to accommodate a user's finger to move the slider from the first position to the second position.

5. The ladder of claim 1, wherein the hanger bar includes a hanger bar extension and a connector assembly coupled to the hanger bar extension at a second end of the hanger bar, and the connector assembly is configured to mate with a first of the two rungs on the ladder.

6. The ladder of claim 5, wherein the platform step includes a rung receiver channel and a connector assembly associated with the rung receiver channel and mounted to the platform step, and the connector assembly is configured to mate with a second rung of the two rungs located at a lower position on the ladder relative to the first rung.

7. The ladder of claim 5, wherein the connector assembly includes a hook having openings therethrough and a catch coupled to the hook, the catch including upper and lower spring tabs protruding through the openings, and when the connector assembly mates with the first rung, and the first rung is an exterior rung mounted externally on one of the frame assemblies, the upper spring tab lies in contact with an upper corner of the first rung and the lower spring tab snaps into cooperative engagement with a lower corner of the first rung and releasably secures the hanger bar to the first rung.

8. The ladder of claim 6, wherein the connector assembly includes a hook having openings therethrough and a catch coupled to the hook, the catch including upper and lower spring tabs protruding through the openings, and when the connector assembly mates with the second rung, and the second rung is an interior rung mounted internally between two frame members, the lower spring tab lies in contact with the second rung and the upper spring tab snaps into cooperative engagement with a rung extension of the second rung to releasably secure the platform step to the second rung.

9. The ladder of claim 1, wherein the means for detachably mounting the platform step comprises a hanger bar coupled at a first end of the hanger bar to a first end of the platform step for rotation relative to the platform step, the hanger bar including a first connector assembly coupled at a second end of the hanger bar and the first connector assembly being configured to mate with a first rung of the ladder, a second connector assembly coupled to a second end of the platform step, the second connector assembly being configured to mate with a second rung of the ladder located at a lower position on the ladder relative to the first rung, and wherein at least one of the connector assemblies includes a hook and a catch coupled to the hook, and when the at least one connector assembly mates with one of the rungs, the hook and the catch cooperate to releasably secure the platform step to the rung.

10. The ladder of claim 1, wherein the means for detachably mounting the platform step includes a pair of hanger bars and a cross bar coupled to a first end of each of the hanger bars and mounted on a first end of the platform step for rotational movement of the cross bar relative to the platform step, the means for detachably mounting the platform step further including a first connector assembly coupled to a second end of each of the hanger bars and a second connector assembly coupled to a second end of the platform step, and further wherein the first connector assemblies are mounted on a first of the two rungs of the ladder and the second connector assembly is mounted on a second of the two rungs located at a lower position on the ladder relative to the first rung.

11. The ladder of claim 1, wherein the platform step includes a top surface, a bottom surface and a lip linking the top and bottom surfaces and defining an underside area of the platform step, and further wherein the level adjuster is mounted on the platform in the underside area.

12. The ladder of claim 11, wherein the platform step further includes a cross bar receiver channel formed in the lip on two opposing sides of and at a first end of the platform step and a rung receiver channel associated with the cross bar receiver channel and located on two opposing sides of and at a second end of the platform step, the cross bar receiver channel being configured to provide means for receiving the cross bar when the frame assemblies are deployed in the extension-ladder mode, and the rung receiver channel is configured to provide means for receiving one of the two rungs when the platform step is mounted on the ladder when the frame assemblies are deployed in either the step-ladder mode or the extension-ladder mode.

13. A ladder comprising a first frame assembly and a second frame assembly coupled to the first frame assembly for pivotable movement relative to the first frame assembly between a deployed extension-ladder mode and a deployed step-ladder mode, each frame assembly including a pair of frame members having a plurality of rungs interconnecting the frame members, a platform including a platform step and means for detachably mounting the platform step on the ladder, adjuster means for selectively adjusting an angle of the platform step relative to one of the frame assemblies, depending upon the deployed mode of the frame assemblies, and wherein the means for detachably mounting the platform step includes a hanger bar and a cross bar coupled to the hanger bar, the cross bar being mounted on the platform step, and further wherein the adjuster means includes a slider, a base and an elongated slot associated with both the slider and the base and configured to matingly receive the cross bar for rotational movement of the cross bar relative to the platform step and for vertical movement therein, and the slider and the base cooperate and to allow the platform step to move to a first angle relative to a frame assembly in a first position of the slider and to lock the platform step at a second angle relative to a frame assembly in a second position of the slider.

14. A platform for a ladder having an extension-ladder mode and a step-ladder mode, the platform comprising a platform step configured to provide means for detachably mounting a first end of the platform step on the ladder, a hanger bar and a cross bar coupled to the hanger bar, the cross bar mounted on a second end of the platform step for rotation relative to the platform step, and the hanger bar being configured to provide means for mounting the hanger bar to the ladder, and a cross bar blocker unit coupled to the platform step, the cross bar blocker unit including a slider, a base and an elongated slot associated with the base and the slider, wherein the slider is configured to allow the cross bar to move within the elongated slot in a first position of the slider and the slider and the base cooperate to lock the cross bar in the elongated slot in a second position of the slider.

15. The platform of claim 14, wherein the slider includes a body, a finger portion coupled to and extending outwardly from a first end of the body, and a plunger portion coupled to and extending outwardly from a second end of the body, the finger portion cooperating with the elongated slot to form a first upper motion-limiter surface to limit upward movement of the cross bar when the slider is in the first position.

16. The platform of claim 15, wherein the plunger portion includes a neck and a handle coupled to the neck, and an exterior surface of the handle is configured to accommodate a user's finger to move the slider from the first position to the second position.

17. The platform of claim 14, wherein the base includes a lock pin to couple the base to the platform step and further includes a cross bar receiver channel configured to receive the cross bar, and further wherein the slider further includes a groove and a detent associated with the groove, the groove configured to receive the lock pin therethrough and the detent configured to releasably lock the slider in a fixed position over the cross bar when the cross bar is in the cross bar receiver channel and the slider is in the second position.

18. The platform of claim 14, wherein the platform step includes a top surface, a bottom surface, and a lip linking the top and bottom surfaces and defining an underside area of the platform step, and further wherein the cross blocker unit is mounted on the platform in the underside area.

19. The platform of claim 18, wherein the platform step further includes a cross bar receiver channel formed in the lip on two opposing sides at a first end of the platform step and a rung receiver channel associated with the cross bar receiver channel and located on two opposing sides of a second end of the platform step, further wherein the cross bar receiver channel is configured to provide means for receiving the cross bar when the frame assemblies are deployed in the extension-ladder mode and the rung receiver channel is configured to provide means for receiving a rung of the ladder when the platform step is mounted on the ladder when the frame assemblies are deployed in either the step-ladder mode or the extension-ladder mode.

20. The platform of claim 14, wherein the hanger bar includes a hanger bar extension and a connector assembly coupled to the hanger bar extension at a first end of the hanger bar, and the hanger bar extension and connector assembly are configured to cooperatively mate with a first rung of the ladder, and further wherein the platform step includes a rung receiver channel and a connector assembly associated with the rung receiver channel and mounted to the platform step, and the rung receiver channel and the connector assembly are configured to cooperatively mate with a second rung of the ladder located at a lower position on the ladder relative to the first rung.

21. The platform of claim 20, wherein the connector assembly includes a hook having openings therethrough and a catch coupled to the hook, the catch including upper and lower spring tabs protruding through the openings, and when the connector assembly mates with the first rung, and the first rung is an exterior rung of the ladder, the upper spring tab is configured to lie in contact with an upper corner of the first rung and the lower spring tab is configured to snap into cooperative engagement with a lower corner of the first rung to releasably secure the hanger bar to the first rung.

22. The platform of claim 21, wherein the connector assembly includes a hook having openings therethrough and a catch coupled to the hook, the catch including upper and lower spring tabs protruding through the openings, and when the connector assembly mates with the second rung, and the second rung is an interior rung of the ladder, the lower spring tab is configured to lie in contact with the second rung and the upper spring tab is configured to snap into cooperative engagement with a rung extension of the second rung to releasably secure the platform step to the second rung.

* * * * *